US005190277A

United States Patent [19]

Rahman et al.

[11] Patent Number: 5,190,277

[45] Date of Patent: Mar. 2, 1993

[54] SHEET SEPARATION DEVICE

[75] Inventors: Mukhles U. Rahman, Penfield; Charles Dolcimascolo, Fairport, both of N.Y.

[73] Assignee: Eastman Kodak Company, Rochester, N.Y.

[21] Appl. No.: 878,075

[22] Filed: May 4, 1992

[51] Int. Cl.[5] ..... B65H 3/02

[52] U.S. Cl. ..... 271/35; 271/121; 271/137

[58] Field of Search ..... 271/34, 35, 121-125, 271/137, 128

[56] References Cited

U.S. PATENT DOCUMENTS 3,768,803 10/1973 Stange ..... 271/34
3,909,979 10/1975 Perez ..... 47/55
4,192,497 3/1980 Perun et al. ..... 271/18
4,844,435 7/1989 Giannetti et al. ..... 271/10
5,110,107 5/1992 Bieber ..... 271/35

OTHER PUBLICATIONS

Materials Engineering (Nov. 1991), "RTV Silicones Seal and Protect", pp. 29-31.

*Primary Examiner*—Richard A. Schacher
*Attorney, Agent, or Firm*—Leonard W. Treash

[57] ABSTRACT

A sheet separation device has a sheet separation member for contacting and feeding the outside sheet from a stack of sheets. The sheet separation member can be a belt, roller or pad and includes a relatively hard support covered by a thin layer of RTV silicone providing a high coefficient of friction.

10 Claims, 3 Drawing Sheets

SHEET SEPARATION DEVICE

This invention relates to sheet separation devices and, more particularly, to a sheet separation device utilizing a belt, roller or pad having a high coefficient of friction.

Scuff sheet separation devices rely on a belt, roller or pad having a high coefficient of friction which contacts the outside surface of an outside sheet of a stack of sheets. The belt, roller or pad is moved in the direction it is desired to move the outside sheet to separate the sheet from the stack. Prevention of double feeds can be accomplished in a number of ways, including the use of a scuff pad, an oppositely rotating roller, the lip of a cartridge or a braked roller. See, for example, U.S. Pat. Nos. 3,909,979; 4,844,435.

The separation member, that is, the belt, roller or pad which contacts the outside surface of the outside sheet to separate it from the stack, must be of a high coefficient of friction. In some instances, when a single sheet is to be fed, it must overcome the resistance of a scuff pad or oppositely rotating roller. Therefore, it must have a higher coefficient of friction than those members. Normally, such a high coefficient of friction would be obtained with a relatively soft material.

U.S. Pat. No. 4,192,497 suggests that retarding members in such systems should be of an intermediate hardness in order to control the sheet without wrinkling or tearing it. It suggests microcellular elastomeric materials having a hardness of between 25 and 40 durometer provide the coefficient of friction necessary without tearing the sheet. This reference is directed at materials for retarding sheets and does not appear to deal with materials for contacting and transporting the sheet to be separated.

SUMMARY OF THE INVENTION

It is an object of the invention to provide a sheet separation device, which device provides both a high coefficient of friction surface for contacting and transporting the sheet to be separated and also the firmness that is necessary for reliable sheet conveyance.

This and other objects are accomplished by using a silicone elastomer having a Shore Å durometer less than 35 which has been applied in a very thin layer on a relatively hard member that provides the stability desired.

According to a preferred embodiment, an RTV silicone elastomer is sprayed or cast onto a metal support in a layer 0.125 inches or less thick, preferably substantially less, for example, between 0.005 and 0.008 inches thick. The sheet separation member can take any form presently known in the art, for example, a belt, roller or pad.

DESCRIPTION OF THE PREFERRED EMBODIMENTS

Silicone elastomers, especially RTV silicones, display a high flexural modulus and a low tensile strength. They are typically used as sealants or adhesives. Although in some forms they have a hardness up to as high as 45 Shore Å durometer, in most instances, they are relatively soft having a Shore Å durometer of 35 or less. They can be applied to other materials in a variety of ways including spraying and coating, including coating in very thin layers. We have found that these characteristics of silicones make them attractive for an application as a sheet separating material.

Figure 1:
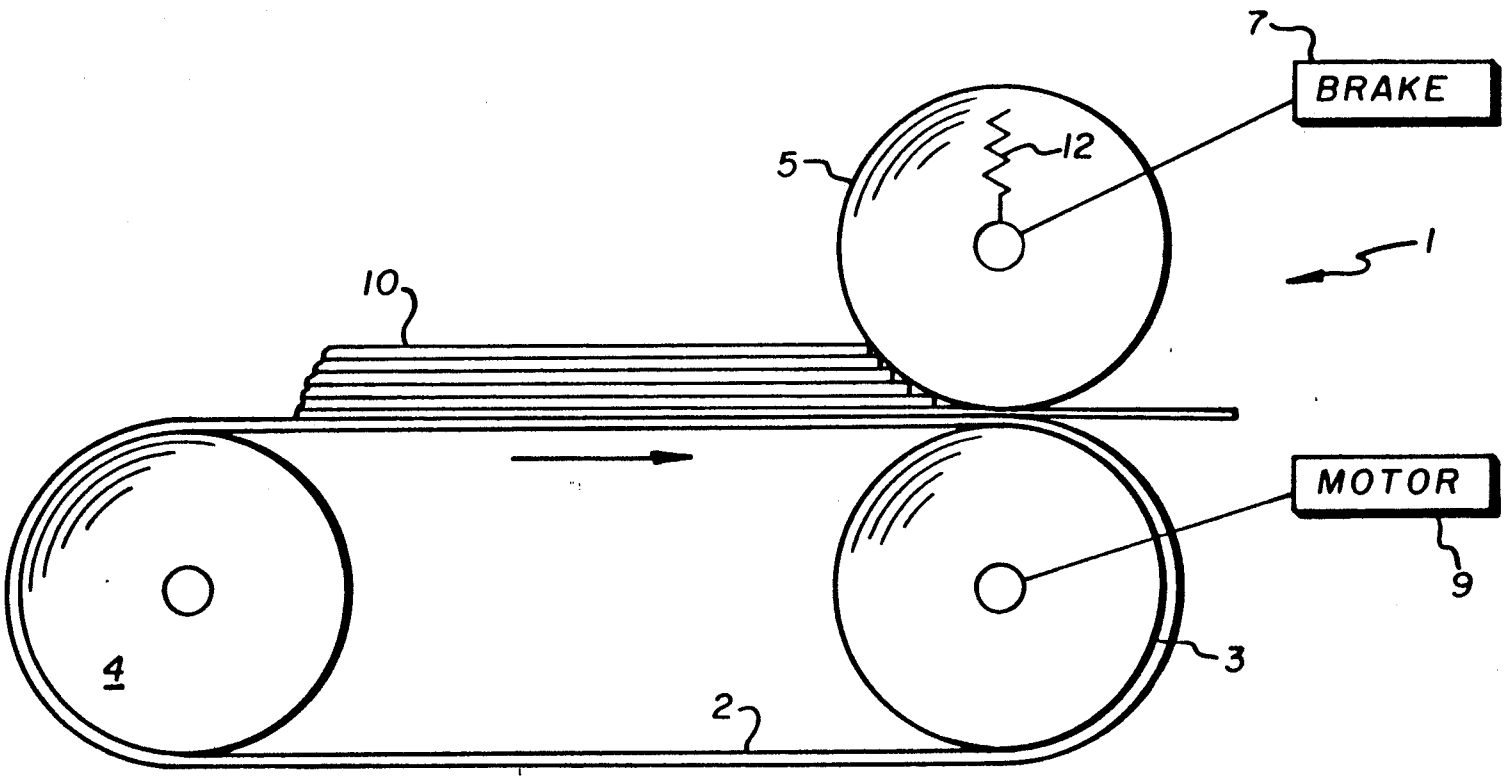
FIG. 1 is a side schematic of a sheet separation device utilizing a belt separation member.

Referring to FIG. 1, a sheet separation device 1 feeds the bottom sheet of a stack 10 from the rest of the stack. The separation device 1 includes an endless belt 2 entrained about a pair of rollers 3 and 4. Roller 3 is driven by a motor 9 to move the belt in a sheet separation direction, as shown in FIG. 1. A retard roller 5 forms a nip with belt 2 and is braked by a brake 7.

The motor 9 drives belt 2 to move the bottom sheet of the stack to the right, as shown in FIG. 1. The second sheet in the stack moves into the nip between belt 2 and roller 5. However, the brake 7 on roller 5 is designed to resist movement of the second sheet. Because the coefficient of friction between the sheets is less than the coefficient of friction of either belt 2 or roller 5, the bottom sheet moves and the second sheet stays in the nip.

Some pressure is applied in the nip by a spring 12. It is important this pressure not be excessive or feeding of even the bottom sheet is difficult. A high coefficient of friction on both belt 2 and roller 5 allows separation without excessive nip pressure. At the same time, it is important that the belt 2, as well as roller 5, be relatively stiff to prevent wrinkling or tearing of the sheet as it is separated and fed.

Figure 2:
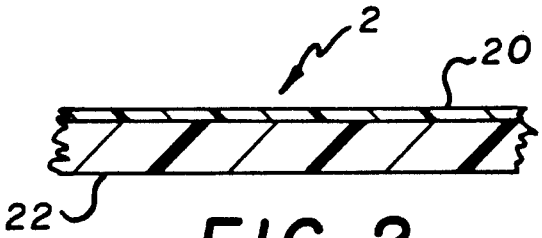
FIGS. 2 and 3 show cross-sections of alternative embodiments of the belt shown in FIG. 1.
Figure 3:
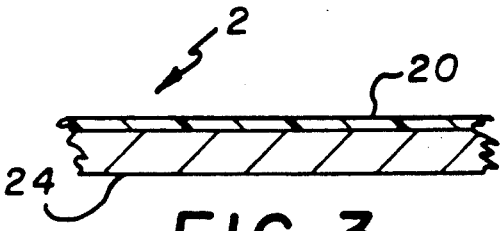

This is accomplished according to either of FIGS. 2 or 3 by providing a very thin coating 20 of RTV silicone material on a hard backing. As shown in FIG. 2, a hard backing 22 can be a hard silicone rubber belt having a Shore Å durometer in excess of 60. Alternatively, as shown in FIG. 3, a hard backing 24 can be metallic; for example, it can be stainless steel or nickel. In each instance, the thin coating of RTV silicone provides a high coefficient of friction for gripping and moving the outside sheet of the stack 10, while the hard backing provides the firmness of support necessary for reliable feeding.

Figure 4:
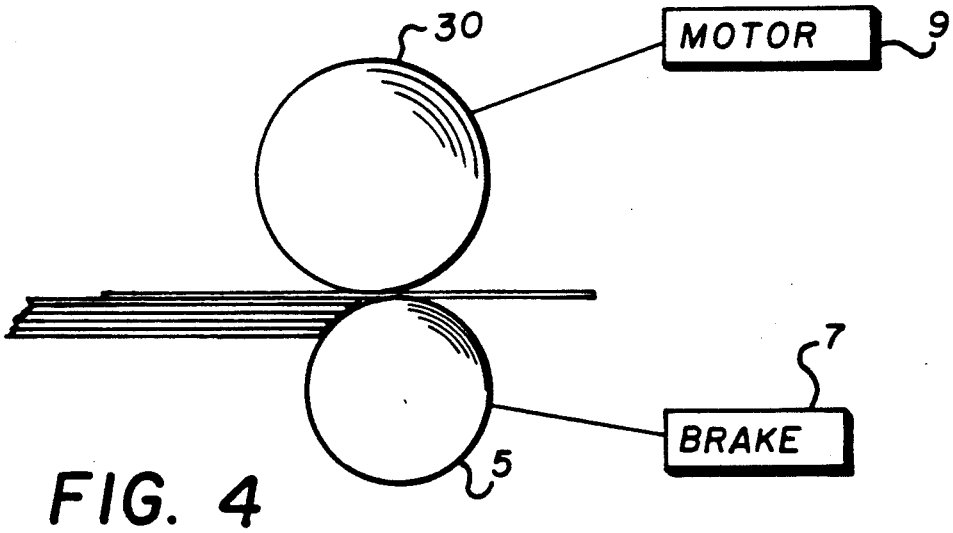
FIG. 4 is a side schematic of a sheet separation device utilizing a roller sheet separation member.
Figure 5:
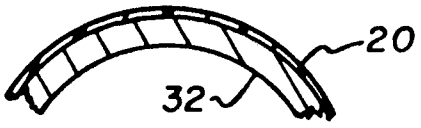
FIG. 5 is a section of a portion of the sheet separation roller shown in FIG. 4.

According to FIGS. 4 and 5, the invention can be applied to top feeding by a feed roller 30. In this instance, roller 30 has an aluminum core 32 with a thin layer 20 of RTV silicone coated on the outside. Other than the materials, the sheet separation device shown in FIG. 4 is conventional. Note that braked retard roller 5 could be replaced with a scuff pad or oppositely driven retard roller.

Again, the silicone elastomer provides a high coefficient of friction while its thinness on the hard metallic backing provides the firmness necessary for reliable feeding.

Figure 6:
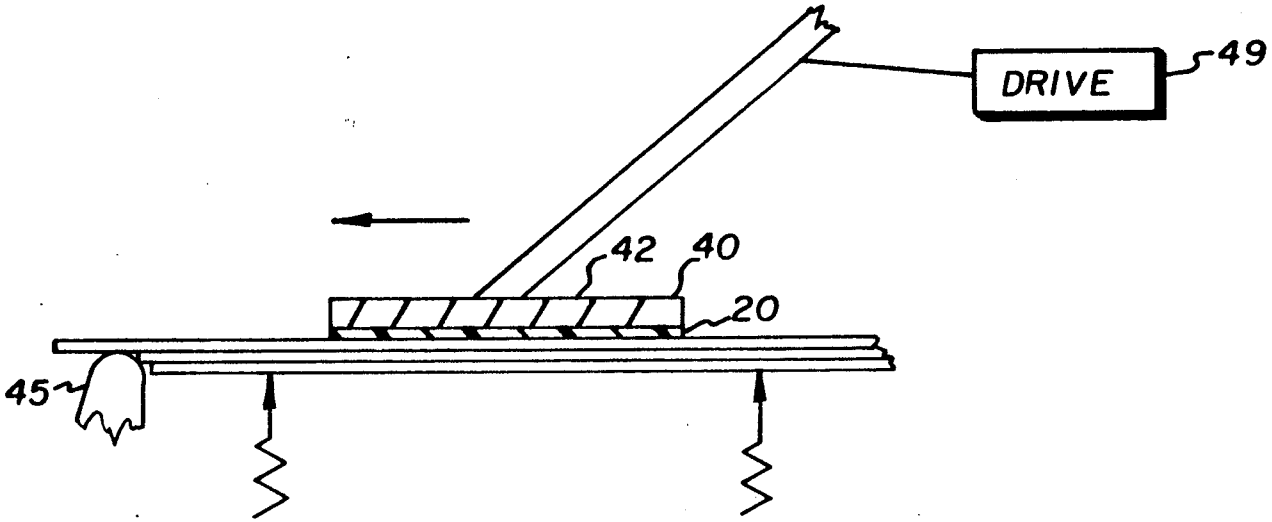
FIG. 6 is a side section of a sheet separation device using a moving pad.

According to FIG. 6, a scuff separation pad 40 is driven by a suitable drive 49 through an elliptical path which repeatedly feeds sheets across a separation lip 45. This type of system is commonly used in cartridges and other similar sheet supply devices. Pad 40 includes a metallic backing 42 and a thin layer 20 of RTV silicone material.

RTV silicone elastomers are a type of dimethylsiloxane. They have been known for a number of years and have been applied to a number of uses in many industries. They come in a variety of formulations. However, the softer forms are characterized by a high coefficient of friction. They are readily coated on metals, hard silicone rubber and other materials. Obviously, for each application, some attention must be paid to chemical compatibility. For this application, unfilled, low durometer silicone elastomers are preferred. Such elastomers generally are cured in an additional or condensation, one or two component process. Typical addition curing uses a chloroplatinic acid catalyst. Condensation curing uses a catalyst such as stannus octoate. Thermal vulcanization uses a benzoyl peroxide cure. For more details on such silicones and their properties and manufacture, see the November 1991 issue of *Materials Engineering*, "RTV Silicones Seal and Protect", pages 29–31.

Although a large number of silicones can be used in this application, some are preferred. For example, an industrial grade RTV silicone adhesive/sealant sold by the Loctite Corporation under the name Loctite Superflex ® 595 in its cured state provides a Shore Å durometer of 27 and has a drying time of approximately 30 minutes when applied by spraying in a thin layer. When applied to a metallic substrate in a thickness of approximately 0.008 inches, it provides a high coefficient of friction with relatively little mechanical instability, making it suitable in each of the applications shown in the FIGS.

Other silicone elastomers can be used. For example, Silastic E® and RTV silicone available from Dow Corning and commonly used in fusing rollers, can be substituted for the Superflex ® 595 material.

Although spraying is preferred, other methods of applying RTV silicones to a harder or firmer material include ring coating, which is usable to provide a coating of 0.008 inches thickness or less, and casting for thicker coatings.

The invention has been described in detail with particular reference to a preferred embodiment thereof, but it will be understood that variations and modifications can be effected within the spirit and scope of the invention as described hereinabove and as defined in the appended claims.

We claim:

1. In a sheet separation device including a sheet separation member for contacting an outside surface of an outside sheet in a stack of sheets, and means for moving the sheet separation member in a direction generally tending to separate the outside sheet from the stack, the improvement wherein the sheet separation member is a relatively hard member covered by a thin layer of a silicone elastomer having a Shore Å durometer less than 35.

2. The improvement according to claim 1 wherein the layer is 0.125 inches thick or less.

3. The improvement according to claim 1 wherein the layer is 0.008 inches thick or less and is an RTV silicone elastomer.

4. The sheet separation device according to claim 1 wherein the sheet separation member is a feed belt.

5. The improvement according to claim 4 wherein the feed belt includes a metallic support for the silicone elastomer layer.

6. The improvement according to claim 4 wherein the feed belt includes a hard rubber support for the silicone elastomer layer.

7. The improvement according to claim 1 wherein the sheet separating member is a metallic feed roller covered by a layer of RTV silicone 0.125 inches thick or less.

8. The improvement according to claim 1 wherein the sheet separation member is a flat feed pad having a metallic support for a thin RTV silicone layer.

9. The improvement according to claim 1 wherein the relatively hard member is metal.

10. The improvement according to claim 1 wherein the layer of RTV silicone is sprayed on the relatively hard member.

* * * * *